US011279582B2

(12) United States Patent
Hilker et al.

(10) Patent No.: US 11,279,582 B2
(45) Date of Patent: Mar. 22, 2022

(54) PROCESS FOR TURNING UP IN A PAPER MACHINE AND PAPER MANUFACTURE

(71) Applicant: PAPRIMA INDUSTRIES INC., Dorval (CA)

(72) Inventors: Dieter H. Hilker, Mascouche (CA); Alfred Neumayer, Schwerte (DE)

( * ) Notice: Subject to any disclaimer, the term of this patent is extended or adjusted under 35 U.S.C. 154(b) by 224 days.

(21) Appl. No.: 16/341,136

(22) PCT Filed: Oct. 17, 2017

(86) PCT No.: PCT/CA2017/051235
§ 371 (c)(1),
(2) Date: Apr. 11, 2019

(87) PCT Pub. No.: WO2018/072018
PCT Pub. Date: Apr. 26, 2018

(65) Prior Publication Data

US 2020/0039777 A1 Feb. 6, 2020

Related U.S. Application Data

(60) Provisional application No. 62/408,958, filed on Oct. 17, 2016.

(51) Int. Cl.
*B65H 19/26* (2006.01)
*B65H 19/28* (2006.01)

(52) U.S. Cl.
CPC ..... *B65H 19/265* (2013.01); *B65H 19/286* (2013.01); *B65H 2301/51512* (2013.01);
(Continued)

(58) Field of Classification Search
None
See application file for complete search history.

(56) References Cited

U.S. PATENT DOCUMENTS 4,546,930 A * 10/1985 Rohde ..... B65H 19/2261 242/521
5,014,924 A * 5/1991 Nowisch ..... B26F 3/004 242/526.3

(Continued)

FOREIGN PATENT DOCUMENTS

CA 2227113 A1 7/1999
CA 2354303 A 1/2003

(Continued)

OTHER PUBLICATIONS

PCT/CA2017/051235 International Preliminary Report dated Apr. 23, 2019.

(Continued)

*Primary Examiner* — Eric Hug
*Assistant Examiner* — Elisa H Vera
(74) *Attorney, Agent, or Firm* — Anglehart et al.

(57) ABSTRACT

A paper-making machine and process, in which a paper web passes over a pope roller to a main roll and a new roll can be brought into contact with the pope roller when the main roll becomes a full roll, is improved by arranging at least two paper cutting tools to cut a paper web from each of two outer lateral edges to form two or more leader portions. A tail of the paper web formed on the full roll is symmetric and the leader portions on the new roll are also symmetric. Adhesive spray or tape can be applied to the paper web in the area of the leader portions. Air jets can also be used to bias the leader portions towards a surface of the new roll.

17 Claims, 6 Drawing Sheets

(52) U.S. Cl.
CPC ..... *B65H 2301/51534* (2013.01); *B65H 2408/236* (2013.01); *B65H 2801/84* (2013.01)

(56) References Cited

U.S. PATENT DOCUMENTS

| | | | | |
|---|---|---|---|---|
| 5,314,132 | A | 5/1994 | Ando et al. | |
| 5,782,426 | A | 7/1998 | Kinnunen et al. | |
| 6,135,000 | A | 10/2000 | Caspar et al. | |
| 6,464,161 | B1 | 10/2002 | Kaipf | |
| 6,709,549 | B2 | 3/2004 | Berglund et al. | |
| 6,863,238 | B1 | 3/2005 | Kojo et al. | |
| 6,978,816 | B1 * | 12/2005 | Byrne | B65H 19/1836 156/157 |
| 8,628,641 | B2 | 1/2014 | Hilker | |
| 2003/0025028 | A1 | 2/2003 | Drefs et al. | |
| 2011/0083795 | A1 | 4/2011 | Kowalewski et al. | |
| 2013/0192785 | A1 | 8/2013 | Hilker | |
| 2015/0007957 | A1 | 1/2015 | Hilker | |

FOREIGN PATENT DOCUMENTS

| | | | |
|---|---|---|---|
| CA | 2395034 | A1 | 1/2003 |
| CA | 2258533 | C | 4/2005 |
| DE | 69620089 | T2 | 8/2002 |
| DE | 10306908 | A1 | 9/2004 |
| DE | 10309049 | A1 | 9/2004 |
| DE | 10309049 | A1 | 9/2004 |
| DE | 202004009144 | U1 | 9/2004 |
| DE | 10343448 | A1 | 4/2005 |
| EP | 0907600 | A1 | 4/1999 |
| EP | 1026110 | A2 | 8/2000 |
| EP | 1035054 | A2 | 9/2000 |
| EP | 1035054 | A2 | 9/2000 |
| EP | 0997417 | B1 | 10/2003 |
| EP | 2100838 | A2 | 9/2009 |
| WO | 97/48632 | A1 | 12/1997 |
| WO | 2004/110910 | A1 | 12/2004 |

OTHER PUBLICATIONS

PCT/CA2017/051235 International Search Report dated Jan. 15, 2018.
PCT/CA2017/051235 Search Strategy dated Jan. 15, 2018.
PGT/CA2017/051235 Written Opinion dated Jan. 15, 2018.
EP 17862698.2 Supplement search report with written opinion dated Oct. 1, 2019.
International application No. PCT/CA2013/050056 International Preliminary Report on Patentability Chapter I dated Aug. 5, 2014.
International application No. PCT/CA2013/050056 International Search Report dated May 15, 2013.
International application No. PCT/CA2013/050056 Search Strategy dated May 15, 2013.
International application No. PCT/CA2013/050056 Written Opinion of the International Searching Authority dated May 15, 2013.
Related U.S. Appl. No. 13/490,747 Office Action dated Jan. 24, 2013.
European application No. 13744115.0 the extended European search report dated Dec. 9, 2016.

* cited by examiner

PROCESS FOR TURNING UP IN A PAPER MACHINE AND PAPER MANUFACTURE

This application claims priority of U.S. provisional patent application 62/408,958 filed Oct. 17, 2016.

TECHNICAL FIELD

This application relates to paper manufacturing, and in particular to a turn up process and apparatus in paper manufacturing.

BACKGROUND

The turn up process in paper manufacturing is the transfer of a paper web from a parent roll to a new roll in a paper making machine. PCT/CA2013/050056 filed 28 Jan. 2013 in the name of Paprima Industries, Inc. and published as WO2013/113110 on 8 Aug. 2013 describes a web turn-up cutting apparatus and method in which an X-shaped cut is performed using water knives that creates two wing portions.

In some circumstances, the wing portions can interfere with the turn up process or otherwise require special operator attention for disposal.

SUMMARY

Applicant has discovered that a paper web can be cut with multiple points turning up. This has the advantage of providing better symmetry of feed of web material at the start of the new roll, while providing a termination to the full reel that is less prone to flapping and/or breaking off of tail material.

Applicant has discovered that a V-shaped or a Y-shaped cut can be used to cause the turn up onto the new roll to happen from both sides of the web without leaving any portion of the web cut away to require disposal, while providing a symmetric feed of web material at the start of the new roll. The V-shape at the same time is formed on the severed end of the completed full roll, which, being approximately symmetrical, is more stable and less prone to loosening or shifting, or tearing off, and therefore is beneficial to the production process.

A paper-making machine and process, in which a paper web passes over a pope roller to a main roll and a new roll can be brought into contact with the pope roller when the main roll becomes a full roll, can be improved by arranging at least two paper cutting tools to cut a paper web from each of two outer lateral edges to form two or more leader portions. A tail of the paper web formed on the full roll is symmetric and the leader portions on the new roll are also symmetric. Adhesive spray or tape can be applied to the paper web in the area of the leader portions. Air jets can also be used to bias the leader portions towards a surface of the new roll.

In some embodiments, there is provided a method for manufacturing paper in a paper-making machine, the method comprising feeding a continuous paper web toward a full roll, using a cutting tool, preferably a water jet cutting tool arranged to cut the paper web on a roll at two or more points, to cause the web to turn up onto a new roll with two or more leader portions, wherein the tail of the web formed on the full roll is symmetric and the leader portions on the new roll are also symmetric, and the full roll is decelerated and removed from the paper making machine.

In some embodiments, there is provided a method for manufacturing paper in a paper-making machine, the method comprising feeding a continuous paper web toward a full roll, using a cutting tool to cause the continuous paper web to turn up onto a new roll with two or more leader portions, decelerating the full roll; and removing the full roll from the paper making machine. In this way, a tail of the web formed on the full roll is symmetric and the leader portions on the new roll are also symmetric.

Preferably, the cutting tool used is a water jet cutting tool arranged to cut the paper web on a roll at two or more points.

Preferably, an adhesive is applied in an area corresponding to the two or more leader portions to help the paper web adhere to the new roll. Preferably, the adhesive is applied to the web, and can be applied using a spray or using a tape.

Preferably, the cutting tool is a water jet cutting tool arranged to cut the paper web on the new roll at two or more points, and the adhesive is provided by residual water on the new roll.

Preferably, the method further comprises providing a plurality of air jets to bias the two or more leader portions towards a surface of the new roll.

Preferably, the two or more leader portions comprise two leader portions, the cutting tool comprising two knifes performing cuts beginning from outer lateral edges of the paper web and joining near a midpoint of the paper web.

Preferably, the two or more leader portions comprise three leader portions, the cutting tool comprising two knifes performing cuts beginning from outer lateral edges of the paper web and the cuts meet, or cross over at least once near the midpoint of the paper web forming two leader portions at the outer lateral edges followed by a leader portion at the midpoint. The cuts may cross over twice near the midpoint.

In some embodiments, there is provided a web turn-up apparatus for use in a paper-making machine in which a paper web passes over a pope roller to a main roll and a new roll can be brought into contact with the pope roller when the main roll becomes a full roll. The apparatus may comprise at least two paper cutting tools arranged to cut a paper web from each of two outer lateral edges to form two or more leader portions. In this way, a tail of the paper web formed on the full roll is symmetric and the leader portions on the new roll are also symmetric.

Preferably, the apparatus further comprises an adhesive applicator.

Preferably, the cutting tools comprise water knife jets. Preferably, the water knife jets are arranged to cut the paper web on the new roll, wherein residual water on the new roll provides an adhesive for the two or more leader portions.

Preferably, the apparatus further comprises a plurality of air jet sources to bias the two or more leader portions towards a surface of the new roll.

BRIEF DESCRIPTION OF THE DRAWINGS

The invention will be better understood by way of the following detailed description of embodiments of the invention with reference to the appended drawings, in which.

DETAILED DESCRIPTION

The following is a description of a process to turn up paper onto a new empty spool, in a machine which makes or converts paper, paperboard, or other type of webs. The particular features of this process are that the process of severing the sheet is initiated from outside the sheet, in order to generate a triangular shaped cut on the full roll, preferably with a water jet, preferably cutting on a roll surface, whereby the cuts join or cross, near the middle of the sheet, and whereby at least 2 points (or all downstream facing points) are adhered to and turned up on the new spool.

The method of severing the sheet from the outside will create an approximately symmetrical triangular shape on the severed end of the sheet going to the full roll. After the turn up, while the full roll is decelerating, such a shape will be less prone to loosening, flapping, or moving sideways, and therefore will be less prone tearing off bits of paper which can fly around and interfere with the production process.

Figure 1A:
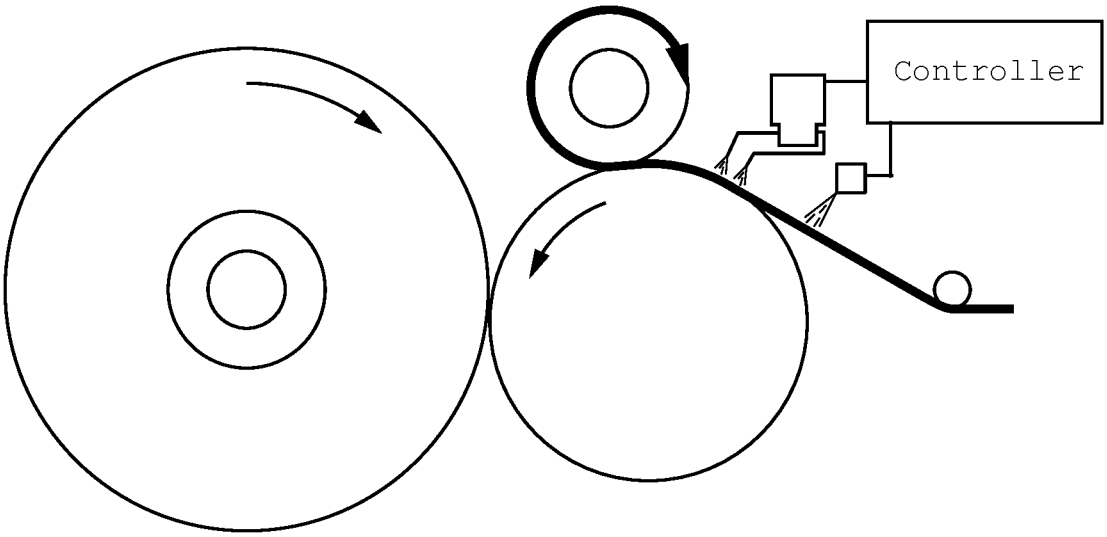
FIG. 1A is a diagram illustrating a side view of wind up equipment in a paper making machine in which a water knife cut is performed on the pope or reel drum or roller showing an adhesive spray unit located before the cutting station.
Figure 2A:
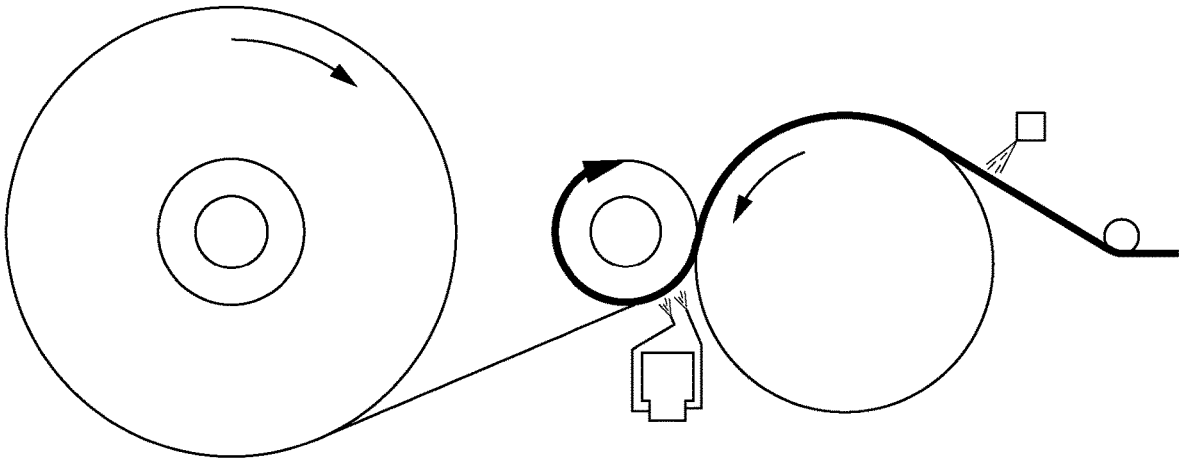
FIG. 2A is a diagram illustrating a side view of wind up equipment in a paper making machine in which a water knife cut is performed on a surface of the new roll following the pope or reel drum or roller showing an adhesive spray unit located before the pope roller.

For most paper types, water jet cutting is best done on a roll so that the severed portion is supported until the turn up. The roll on which the paper web is cut can be the pope roller and the reel drum against which the new roll is contacted, as illustrated in FIG. 1A. An adhesive sprayer or application device can work in conjunction with the cutting device as illustrated. Alternatively, when the new roll is positioned as illustrated in FIG. 2A, the web can wrap partially around the new roll, and the water knives can cut the web on the new roll.

Figure 1B:
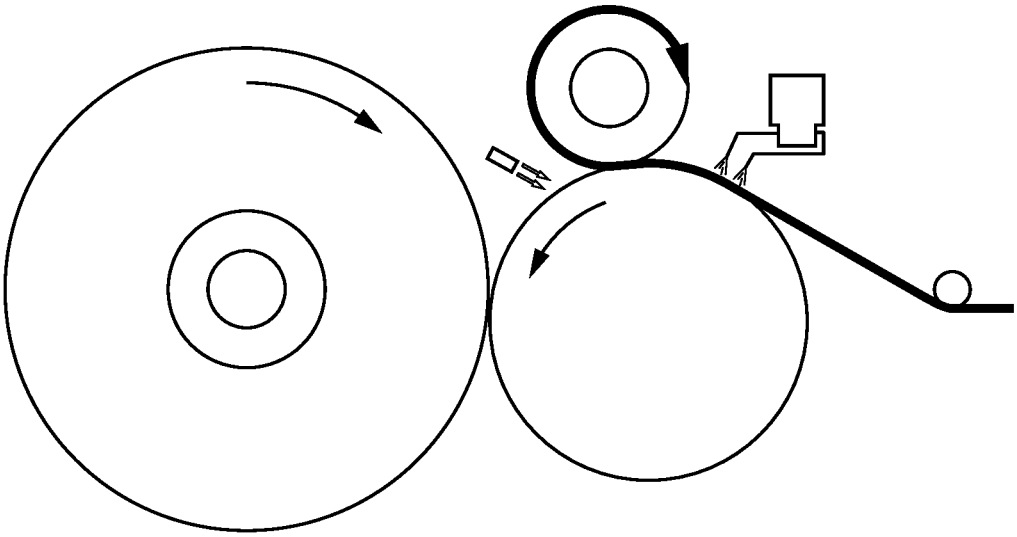
FIG. 1B is a diagram illustrating a side view of wind up equipment in a paper making machine in which a water knife cut is performed on the pope or reel drum or roller showing an air jet located on the pope roller to redirect the severed web up onto the new roll.
Figure 2B:
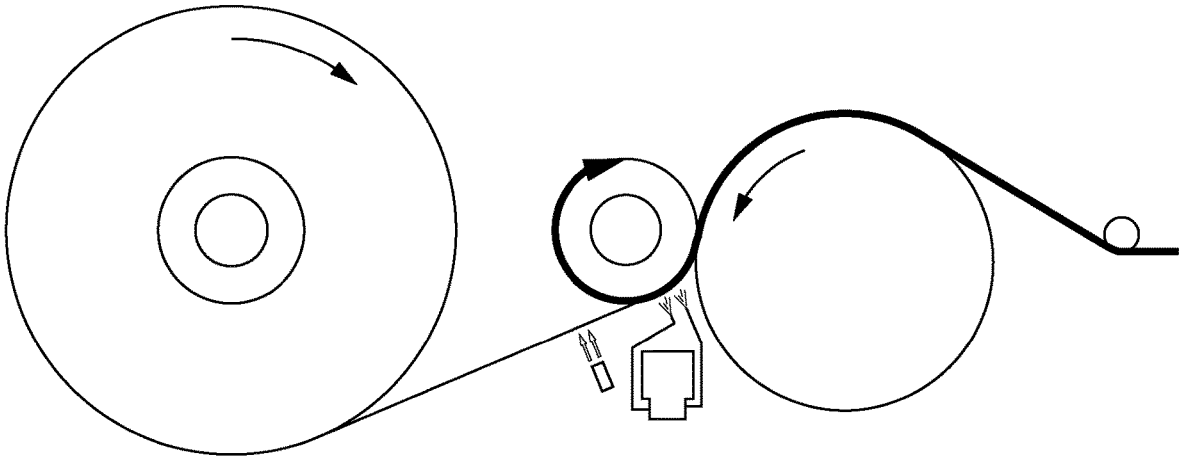
FIG. 2B is a diagram illustrating a side view of wind up equipment in a paper making machine in which a water knife cut is performed on a surface of the new roll following the pope or reel drum or roller showing an air jet located after the new roll to redirect the severed web up onto the new roll.

Instead of or in addition to the use of adhesive, a plurality of air jet nozzles or sources can be provided as illustrated in FIGS. 1B and 2B to direct or to bias the leader portions towards a surface of the new roll. In the case of FIG. 1B, this involves an air knife that peels the web away from the pope roller and deflects the leader portions towards the new reel.

Figure 3A:
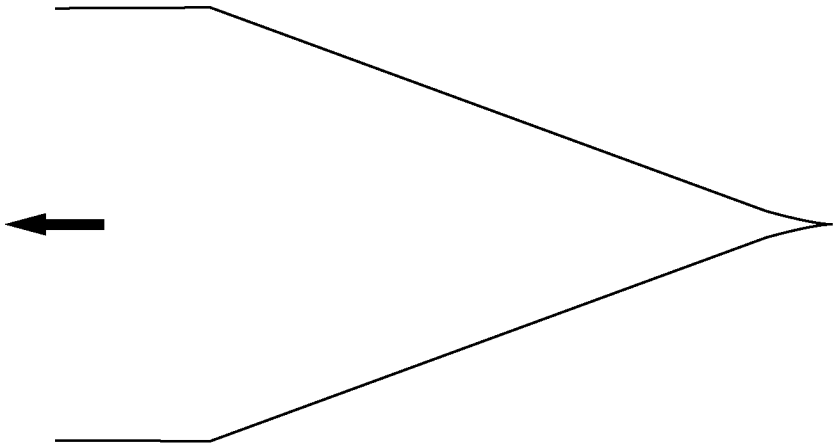
FIG. 3A is a diagram showing a triangular shape cut at the tail on the full roll.

FIG. 3A shows the triangular shape on the full roll.

Figure 3B:
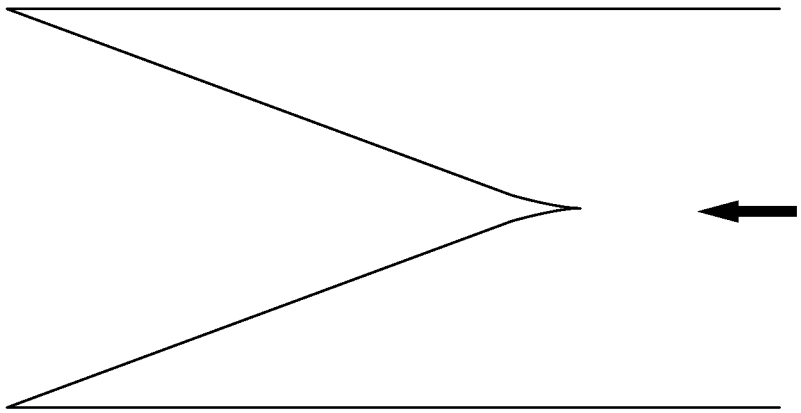
FIG. 3B is a diagram showing a two point leader portion of the web forming the new roll.

A corresponding inverted triangular shape will then be created on part of the sheet which will be turned up on the new spool, as shown in FIG. 3B. The result is that there are at least 2 points which will turn up onto the spool. The points will be adhered to the new spool.

Figure 4A:
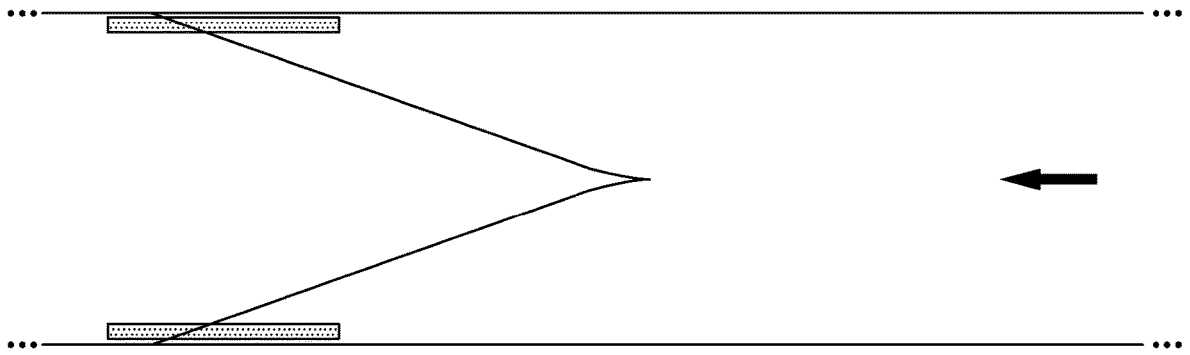
FIG. 4A is a diagram showing a two point turn up (non-crossing) in which the cuts stop when they join, with adhesive applied to the 2 leading points.
Figure 4B:
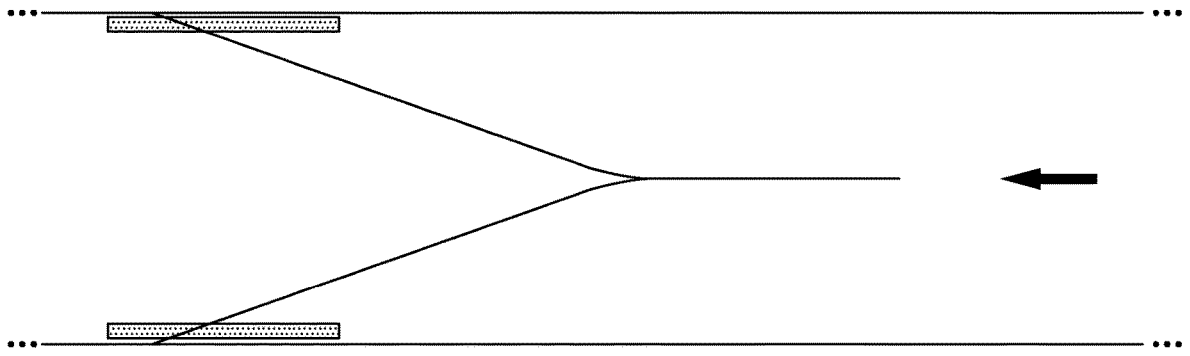
FIG. 4B is a diagram showing a two point turn up (non-crossing) in which the cuts stop after they join, with adhesive applied to the 2 leading points.
Figure 5:
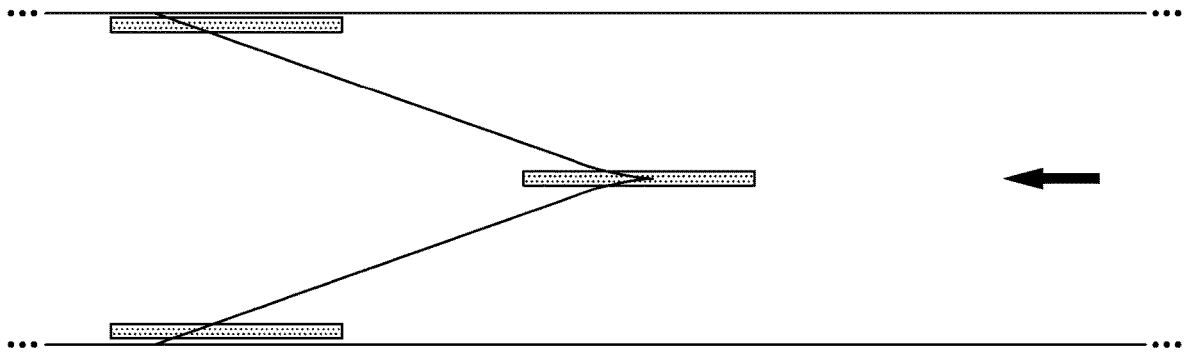
FIG. 5 is a diagram showing a two point turn up (non-crossing) in which additional adhesive is applied to the base of the V or Y of the cut.

There are various profile possibilities. For example, in FIG. 4A, adhesive can be applied to the sides where the cuts are started, preferably before and after the cut. The cuts can stop immediately when they join as in FIG. 4A, or they can stop after they join as shown in FIG. 4B. FIG. 5 shows that adhesive can be applied in the middle of the web where the cut lines join.

The cuts are initiated from outside the sheet, and join, at or near the middle of the sheet. It is advantageous to reduce paper cutting loss by pressurizing the jet outside the sheet. The cutting stops preferably when both cuts meet, which reduces paper cutting loss. The cut can be stopped quickly by various methods not discussed here. The cut may also stop after the cuts meet.

Adhesive can be applied onto the sheet (directly or indirectly) close to each of the sheet edges, so that there is adhesive on at least the upstream extremity of any upstream side (leading edge) of the cut for the purpose of adhering the sheet to the new spool, and preferably additionally on the downstream side (trailing edge) of the cut, for the purpose of adhering the severed downstream part of the sheet to the full roll to assist in preventing the wound paper from loosening. The adhesive may be a sprayed liquid, or tape. If sprayed, the location of the adhesive applicator may be either up- or downstream of the cutting device. In the case of tape, the location of the applicator is preferably upstream of the cutting device, so that the tape will be severed along with the web.

Adhesive can additionally be applied onto the sheet (directly or indirectly) generally in the middle and in line with the point of the triangular shaped trailing edge, so that there is adhesive at least on the downstream side of the cut, for the purpose of adhering the triangular point to the full roll. This is advantageous to assist in preventing the wound full roll from loosening.

It will be appreciated that water can also act as an adhesive for the web to adhere to the desired roll. When water is used as the sprayed liquid, a separate nozzle can be used, or alternatively, the water cutting jet can also be used for applying water to act as the adhesive. This can be done by having the water knife arranged on the opposite side of the sheet as in FIG. 2 so that the water from the water knife goes through the paper and onto the surface of the new spool, and can adhere the paper. This water is a "sprayed liquid" but it does not need a separate applicator.

In addition to spraying a liquid or using a tape for adhesion purposes, it will be appreciated that air can be used to blow up the tip. This applies, for example, to configurations like the ones illustrated in FIGS. 1B and 2B. The air blowing device would be located on the downstream side of the new spool.

Figure 6:
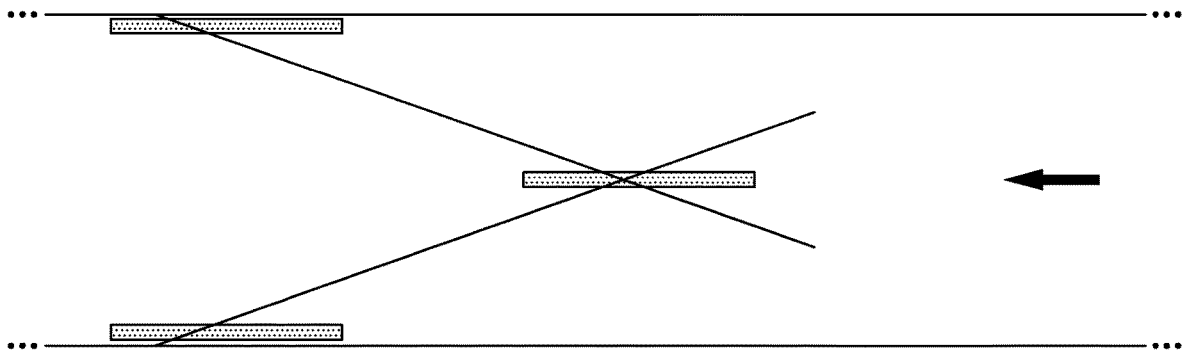
FIG. 6 is a diagram showing a three point turn up (crossing) in which the cuts stop after they cross within the sheet, with adhesive applied to the 3 leading points.

In the embodiment of FIG. 6, the cuts are initiated from outside the sheet, and at least meet or cross, at or near the middle of the sheet, and whereby a central leading edge point or points is/are created. It is advantageous to reduce paper cutting loss by pressurizing the jet outside the sheet. As shown in FIG. 6, the cutting stops after both cuts cross, and before reaching the adjacent sheet edge. This is advantageous, as the severed portion of the sheet turning up onto the new spool is contiguous, and therefore can be completely unwound without interruption.

Figure 7:
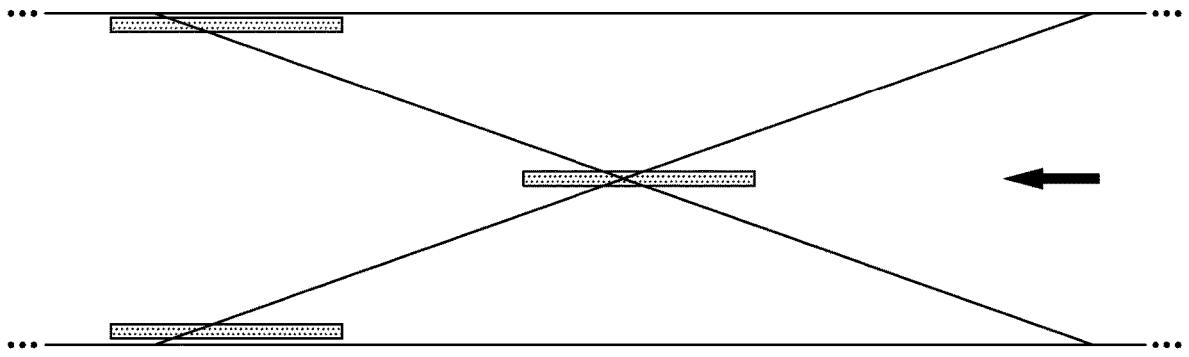
FIG. 7 is a diagram showing a three point turn up (crossing) in which the cuts do not stop after they cross within the sheet, with adhesive applied to the 3 leading points.

As shown in FIG. 7, the cutting in this embodiment does not stop after both cuts meet, and completely severs the sheet. As shown in FIG. 7, adhesive is applied onto the sheet (directly or indirectly) close to each of the sheet edges, and also at the crossing point or points, so that there is adhesive on at least the upstream extremity of any upstream side (leading edge) of the cut for the purpose of adhering the sheet to the new spool, and preferably additionally on the downstream side (trailing edge) of the cut, for the purpose of adhering the severed downstream part of the sheet to the full roll to assist in preventing the wound paper from loosening. The adhesive may be a sprayed liquid, or tape. If sprayed, the location of the adhesive applicator may be either up- or downstream of the cutting device. In the case of tape, the location of the applicator is preferably upstream of the cutting device, so that the tape will be severed along with the web.

Figure 8:
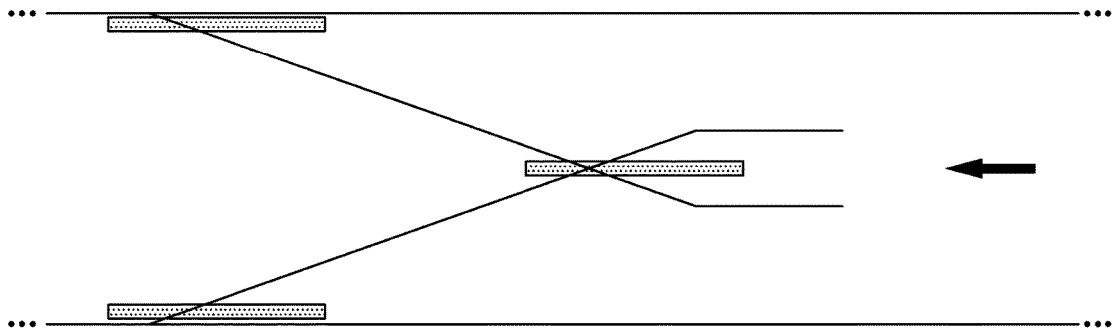
FIG. 8 is a diagram showing a three point turn up (crossing) in which the cuts stop after they cross within the sheet with a deviated path, with adhesive applied to the 3 leading points.
Figure 9:
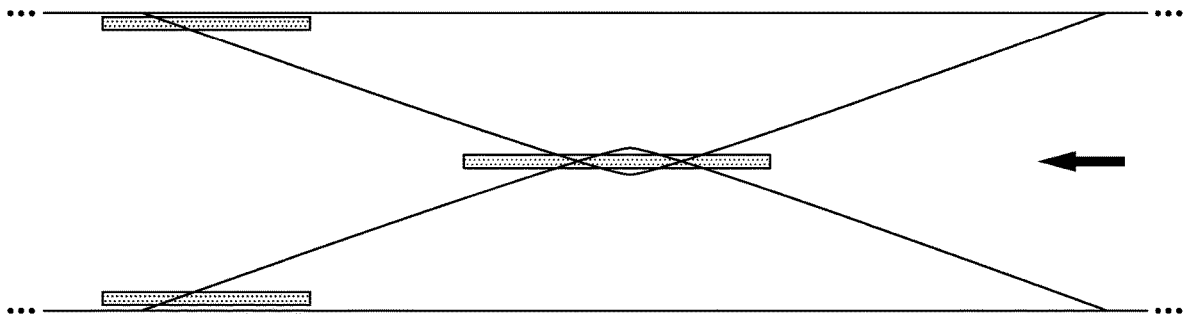
FIG. 9 is a diagram showing a four point turn up (crossing) in which the cuts do not stop after they cross within the sheet with an alternative path, with adhesive applied to the four leading points.
Figure 10:
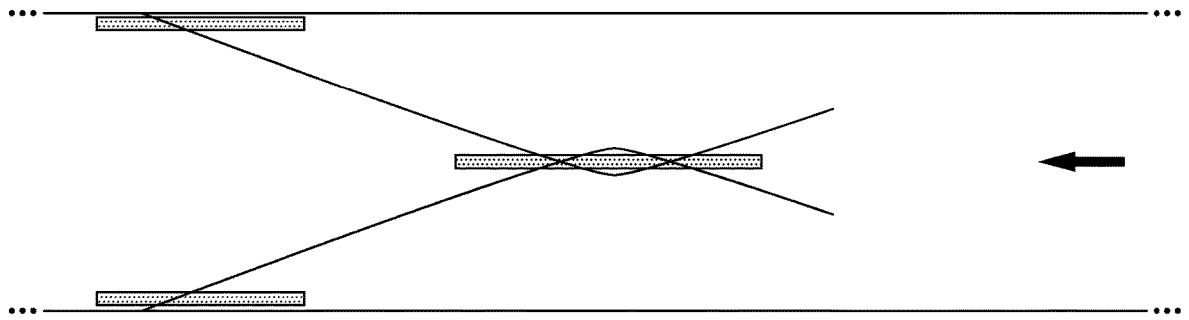
FIG. 10 is a diagram showing a four point turn up (crossing) in which the cuts stop after they cross within the sheet with an alternative path, with adhesive applied to the four leading points.

In the embodiments of FIGS. 8 and 9, an alternative motion of the cutting mechanism (e.g. water jets) generates profiles of different shapes. In FIG. 8, the motion of the cutting tool is arrested. In FIG. 9, the cutting tools generate profiles which meet once, or cross twice before continuing to the lateral sides edges. In the embodiment of FIG. 10, the cuts are stopped after the second crossing.

It is possible to prevent a water knife jet from cutting or applying water to the paper web at the end of its cut by positioning an absorbing member or deflecting member in the final position path of the water knife.

In some embodiments, the water knife cutting tool can comprise a motorized mounting supporting two or more water knife nozzles with a processor (or other electronic hardware) based controller for controlling the motion of the nozzles, actuation of the water jets and optionally any adhesive supplying devices, as shown in FIG. 1A. Details of such an apparatus can be found, for example, in PCT/CA2013/050056 filed 28 Jan. 2013 in the name of Paprima Industries, Inc. and published as WO2013/113110 on 8 Aug. 2013. In these embodiments, the method as described above can be performed by providing processor instructions to cause the water knife nozzles to cut the paper web with the improved cutting pattern as described above. These instructions can be stored in a memory product that when loaded into the processor (or configurable hardware) of the turn-up apparatus will cause the apparatus to perform an improved turn-up as described above.

The invention claimed is:

1. A method for manufacturing paper in a paper-making machine, the method comprising:

feeding a continuous paper web toward a full roll;

using a cutting tool to cause the continuous paper web to turn up onto a new roll with three or more leader portions, said cutting tool performing cuts beginning from outer lateral edges of said paper web and crossing over at least once near a midpoint of said paper web, thereby forming first and second leader portions at said outer lateral edges followed by a third leader portion located at said midpoint upstream from said first and second leader portions on the new roll;

decelerating the full roll; and removing the full roll from the paper making machine;

wherein a tail of the web formed on the full roll is symmetric and triangular shaped and the first and second leader portions on the new roll are also symmetric.

2. The method as defined in claim 1, wherein said cutting tool used is a water jet cutting tool arranged to cut the paper web on a roll at two or more points.

3. The method as defined in claim 1, further comprising applying an adhesive in an area corresponding to said three or more leader portions to help said paper web adhere to said new roll.

4. The method as defined in claim 3, wherein said adhesive is applied to said web.

5. The method as defined in claim 4, wherein said adhesive is applied using a spray.

6. The method as defined in claim 4, wherein said adhesive is applied using a tape.

7. The method as defined in claim 3, wherein said cutting tool used is a water jet cutting tool arranged to cut the paper web on said new roll at two or more points, and said adhesive is provided by residual water on said new roll.

8. The method as defined in claim 1, further comprising providing a plurality of air jets to bias said three or more leader portions towards a surface of said new roll.

9. The method as defined in claim 1, wherein said three or more leader portions comprise three leader portions, said cutting tool comprising two knifes, each knife performing a respective cut beginning from one of the outer lateral edges of said paper web.

10. The method as defined in claim 9, wherein said cuts cross over twice near said midpoint.

11. A web turn-up apparatus for use in a paper-making machine in which a paper web passes over a pope roller to a main roll and a new roll can be brought into contact with the pope roller when the main roll becomes a full roll, the apparatus comprising:

a cutting tool arranged to cut the paper web from each of two outer lateral edges and a controller connected to the cutting tool configured to form three or more leader portions for turning up onto the new roll, said cutting tool comprising two knifes, the controller configured to cause each knife to make a respective cut beginning from one of the outer lateral edges of said paper web and crossing over the other cut at least once near a midpoint of said paper web, the cuts generating first and second leader portions in said paper web at said outer lateral edges followed by a third leader portion located at said midpoint upstream from said first and second leader portions on the new roll;

wherein a tail of the paper web formed on the full roll is symmetric and triangular shaped and the first and second leader portions on the new roll are also symmetric.

12. The apparatus as defined in claim 11, further comprising an adhesive applicator.

13. The apparatus as defined in claim 11, wherein said cutting tool comprises a pair of water knife jets.

14. The apparatus as defined in claim 13, wherein said water knife jets are arranged to cut said paper web on said new roll, wherein residual water on said new roll provides an adhesive for said three or more leader portions.

15. The apparatus as defined in claim 11, further comprising a plurality of air jet sources to bias said three or more leader portions towards a surface of said new roll.

16. The apparatus as defined in claim 11, comprising an electronic controller for controlling at least one motor controller and cutting actuator of said cutting tool, said electronic controller comprising a processor or configurable hardware.

17. A non-transitory memory product storing instructions for a processor or configurable hardware of a web turn-up apparatus, said instructions causing said apparatus to perform the method as defined in claim 1.

* * * * *